US009192793B2

(12) United States Patent
Patil et al.

(10) Patent No.: US 9,192,793 B2
(45) Date of Patent: Nov. 24, 2015

(54) ABRASIVE BLAST RESPIRATOR

(71) Applicant: Honeywell International Inc., Morristown, NJ (US)

(72) Inventors: Swapnil Gopal Patil, Maharashtra (IN); Joseph Rodrigues, Cranston, RI (US); Joseph Venagro, Cranston, RI (US); Karl Schart, Coventry, RI (US)

(73) Assignee: Honeywell International Inc., Morristown, NJ (US)

( * ) Notice: Subject to any disclaimer, the term of this patent is extended or adjusted under 35 U.S.C. 154(b) by 360 days.

(21) Appl. No.: 13/683,013

(22) Filed: Nov. 21, 2012

(65) Prior Publication Data

US 2014/0116429 A1 May 1, 2014

(30) Foreign Application Priority Data

Oct. 25, 2012 (IN) ..... 3296/DEL/2012

(51) Int. Cl.

| | |
|---|---|
| ***A62B 7/10*** | (2006.01) |
| ***A62B 17/04*** | (2006.01) |
| ***A62B 23/02*** | (2006.01) |
| ***A62B 7/12*** | (2006.01) |

(52) U.S. Cl.

CPC ... *A62B 7/10* (2013.01); *A62B 7/12* (2013.01); *A62B 17/04* (2013.01); *A62B 23/02* (2013.01)

(58) Field of Classification Search

CPC ..... A62B 18/08; A62B 17/04; A62B 17/00; A62B 18/00; A62B 18/006; A62B 18/082; A62B 18/025; A62B 18/084; A62B 23/02; A62B 23/00; A62B 18/02; A62B 19/00; A62B 7/10; A62B 18/10; A62B 7/00; A62B 9/04; B23P 17/00; B29C 63/22; B29C 45/14311

USPC ..... 128/201.22, 201.23, 201.25, 201.28, 128/201.19, 204.23, 205.12, 201.24, 128/207.12, 206.12, 206.15, 206.17, 128/206.22, 206.24, 206.28, 201.15, 857, 128/201.29, 205.25, 205.27, 205.29, 128/206.21, 206.23, 206.19; 2/9, 429, 434, 2/427

See application file for complete search history.

(56) References Cited

U.S. PATENT DOCUMENTS

| | | | | |
|---|---|---|---|---|
| 2,529,106 | A | 11/1950 | Schauweker | |
| 3,291,126 | A | 12/1966 | Messick | |
| 3,739,774 | A * | 6/1973 | Gregory | 128/201.28 |

(Continued)

FOREIGN PATENT DOCUMENTS

| | | |
|---|---|---|
| EP | 1810648 A1 | 7/2007 |
| WO | 9741815 | 11/1997 |

OTHER PUBLICATIONS

MSA the Safety Company: Advantage® 4000 Abrasi-Blast™ Respirator, Information Sheet, msanet.com, 8 pages, 2011.

(Continued)

*Primary Examiner* — Annette Dixon

(74) *Attorney, Agent, or Firm* — Conley Rose, P.C.; Kristin Jordan Harkins

(57) ABSTRACT

Embodiments relate to improvements for supplied-air abrasive blast respirators. Embodiments may comprise purified air via filters as a back-up air supply, with the filters typically operating automatically to provide purified air when the supplied air is compromised. Embodiments may locate elements outside of the hood to provide ready access for performing seal checks. Embodiments may incorporate noise reduction elements and/or lens protection elements as well.

20 Claims, 12 Drawing Sheets

(56) References Cited

U.S. PATENT DOCUMENTS

| | | | | |
|---|---|---|---|---|
| 3,945,044 | A | 3/1976 | McGee et al. | |
| 3,963,021 | A | 6/1976 | Bancroft | |
| 4,076,373 | A | 2/1978 | Moretti | |
| 4,127,130 | A | 11/1978 | Naysmith | |
| 4,256,386 | A * | 3/1981 | Herbert | 351/43 |
| 4,414,973 | A | 11/1983 | Matheson et al. | |
| 4,494,538 | A | 1/1985 | Ansite | |
| 4,542,538 | A | 9/1985 | Moretti et al. | |
| 4,592,350 | A | 6/1986 | Maryyanek et al. | |
| 4,648,394 | A * | 3/1987 | Wise | 128/201.24 |
| 4,846,166 | A | 7/1989 | Willeke | |
| 4,873,972 | A | 10/1989 | Magidson et al. | |
| 4,886,058 | A | 12/1989 | Brostrom et al. | |
| 4,930,539 | A | 6/1990 | van Rooy | |
| 4,961,420 | A * | 10/1990 | Cappa et al. | 128/207.12 |
| H863 | H | 1/1991 | Kwiedorowicz et al. | |
| 4,989,598 | A | 2/1991 | Berg et al. | |
| 5,299,448 | A | 4/1994 | Maryyanek et al. | |
| 5,431,156 | A * | 7/1995 | Sundstrom | 128/201.23 |
| 5,549,104 | A | 8/1996 | Crump et al. | |
| 6,102,033 | A | 8/2000 | Baribeau et al. | |
| 6,408,845 | B1 | 6/2002 | Pereira et al. | |
| 7,293,560 | B2 | 11/2007 | Dahrendorf et al. | |
| 7,464,705 | B2 * | 12/2008 | Tanizawa et al. | 128/201.25 |
| 7,762,252 | B2 | 7/2010 | Prete | |
| 7,975,688 | B1 | 7/2011 | Truitt | |
| 8,028,695 | B2 | 10/2011 | Acker et al. | |
| 8,176,913 | B2 | 5/2012 | Ivory | |
| 8,402,966 | B2 * | 3/2013 | Morgan et al. | 128/201.25 |
| 8,707,472 | B2 * | 4/2014 | Stachler et al. | 2/428 |
| 2009/0194101 | A1 | 8/2009 | Kenyon et al. | |
| 2009/0241965 | A1 | 10/2009 | Sather et al. | |
| 2009/0266361 | A1 | 10/2009 | Bilger et al. | |
| 2010/0287688 | A1 * | 11/2010 | Stachler et al. | 2/424 |
| 2011/0036347 | A1 | 2/2011 | Morgan, III et al. | |
| 2012/0152255 | A1 | 6/2012 | Barlow et al. | |
| 2014/0115864 | A1 * | 5/2014 | Patil et al. | 29/453 |
| 2014/0116430 | A1 * | 5/2014 | Patil et al. | 128/201.25 |

OTHER PUBLICATIONS

CLEMCO; www.clemcoindustries.com, Job No. 2317-0506, Rev. C 0111; Apollo 600 Supplied-Air Respirator for Abrasive Blasting; 4 pages, 2011.

rpb® nova 3®, Ultra Performance, Heavy Industry Respirator, IS99001 Accredited Company; www.rpbsafety.com; 4 pages.

Bullard 88VX™ Series Airline Respirator User Manual; 20 pages, 2011.

PCT/US2011/044229; International Preliminary Report on Patentability and Written Opinion; Jan. 22, 2013; 6 pages.

* cited by examiner

ABRASIVE BLAST RESPIRATOR

CROSS-REFERENCE TO RELATED APPLICATIONS

This application claims priority to India Provisional Patent Application Serial No. 3296/DEL/2012 entitled "Abrasive Blast Respirator", filed Oct. 25, 2012 in the India Patent Office.

STATEMENT REGARDING FEDERALLY SPONSORED RESEARCH OR DEVELOPMENT

Not applicable.

REFERENCE TO A MICROFICHE APPENDIX

Not applicable.

FIELD

Embodiments may relate generally to respirators, and more specifically to supplied-air abrasive blast respirators.

BACKGROUND

Abrasive blasting, such as sand blasting or shot blasting using grit particulates, is often used in industry, for example to clean equipment. In the shipbuilding industry, for example, abrasive blasting may be used to clean away accumulations (of dirt, salt, rust, paint, scale, etc.) from ships during construction and/or maintenance of ships. During abrasive blasting, air pressure as high as 100 psi and nozzle velocities of 650-1700 feet per second maybe common. Workers often must climb into tight or confined spaces and/or be in general proximity to the blowback of abrasive grit particulates during abrasive blasting. Thus, there is a need for protective equipment to protect workers from the harsh conditions of abrasive blasting. Such protective equipment may improve worker efficiency, comfort, and safety, and may be required by governmental regulation.

For example, workers may wear respirators to protect them from breathing the abrasive grit during abrasive blasting. Some respirators might also include protection for the workers' eyes. Respirators for use in abrasive blasting typically use supplied-air (with pressurized air pumped through a hose, line, or tube to the respirator for continuous flow), either as a governmental requirement and/or based on customary usage in the industry. Current respirator devices, however, may have issues with noise, ergonomics, safety, etc. Applicants have therefor developed improved abrasive blast respirator embodiments.

SUMMARY

Aspects of the disclosure may include embodiments of a supplied-air respirator comprising one or more of the following: a hood; and a facepiece having an inhalation valve, an exhalation valve, and at least one filter located thereon; wherein the inhalation valve, exhalation valve, and at least one filter are located exterior to the hood, and thus not covered by the hood. In some embodiments, the at least one filter may comprise a valve and operates to provide back-up air supply by filtering outside, air in the event that supplied air through the inhalation valve is compromised (and typically only when supplied air has been compromised). In some embodiments, the inhalation valve may be an inhalation check valve biased closed but operable to open upon application of supplied air pressure of at least about 1 psi in a breathing hose attached to the inhalation valve. In some embodiments, the valve of the at least one filter may be operable to open based on inhalation (suction force) by a user breathing in the absence of supplied air through the inhalation check valve (for example, when the inhalation check valve is closed or based on closure of the inhalation check valve).

In embodiments, the respirator may further comprise a removable protective cover that shields the inhalation valve, exhalation valve, and/or at least one filter from exposure to an abrasive blast environment. The cover in some embodiments may snap into place onto the facepiece (by tab interaction with the at least one filter, for example) and is operable to removably snap off the facepiece to provide ready access to the at least one filter and the exhalation valve to allow a user to perform positive and negative seal checks. This location of elements (such as the inhalation valve, exhalation valve, and/or filter(s)) may allow for seal check(s) to be performed exterior to the hood, without movement of the hood from its position for abrasive blasting, and/or without changing the hood configuration from that for abrasive blasting. And in some embodiments, the element(s) may be located on the front portion of the facepiece, typically below the lens, to provide visual cues. In some embodiments, the inhalation check valve may comprise a porous airflow element (for example nonwoven polyester such as felt) that alters airflow turbulence exiting the inhalation check valve without significantly restricting airflow rate (through the inhalation check valve) into the facepiece. In some embodiments, the porous airflow element may minimize, reduce, or eliminate turbulence.

The respirator of some embodiment may further comprise a removable lens cartridge that snaps onto the facepiece. The removable lens cartridge may have a plurality of removable molded plastic protective lenses stacked in series with gasket seals between adjacent lenses, with each gasket seal typically securely affixed to the inner surface of an outer adjacent lens and in sealing contact (but not securely affixed to) the outer surface of an inner adjacent lens. With such a gasket seal embodiment, when each lens is removed from the cartridge, the gasket seal may be (entirely) removed with the lens, with no portion of the gasket remaining behind. In some embodiments, the respirator may further comprise a muffler housing block having a pressure relief valve (which typically prevents excess pressure from damaging the breathing hose), wherein the breathing hose typically does not include a spring therein. In some embodiments, the muffler housing block may further comprise a porous plastic muffler element. The respirator may further comprises a porous airflow element (for example nonwoven polyester such as felt) that alters airflow turbulence entering the breathing hose from the muffler housing block without significantly restricting airflow rate into the breathing hose (typically located in proximity to the interface, of the muffler housing block and the breathing hose).

Additional aspects of the disclosure may include embodiments of a supplied-air respirator comprising: a hood; and a facepiece having an exhalation valve and an inhalation valve thereon; wherein the exhalation valve is not covered by the hood (when the respirator is in place on a user ready for abrasive blasting). In some embodiments, the inhalation valve may also not be covered by the hood. The respirator of some embodiment may further comprise one or more removable cover that shields the inhalation valve and/or exhalation valve. The cover typically protects the inhalation valve and/or exhalation valve from exposure to an abrasive blast environment (and/or blowback of abrasive grit). In some embodiments, the respirator may further comprise one or more filters located on the facepiece. Typically when filters are present, the inhalation valve may be biased closed but operable to open upon application of sufficient pressure (for example about 1 psi or about 2 psi in some embodiments) in a breathing hose attached to the inhalation valve, and the one or more filters each may comprise a valve and operate to provide back-up air supply by filtering outside air in the event that supplied air through the inhalation valve is compromised as indicated by a drop in supplied air pressure through the inhalation valve and/or closing of the inhalation valve. In some embodiments, the one or more filters are not covered by the hood. In some embodiments, the respirator may further comprise a removable protective cover that shields the exhalation valve and/or the one or more filters, offering protection from exposure to an abrasive blast environment (while providing access to external air to the one or more filters).

Still other aspects of the disclosure may include embodiments of a supplied-air respirator comprising: a breathing hose for providing pressurized air supply; an exhalation valve; and one or more purifying filters operable to prevent grit of an abrasive blast environment from entering the respirator; wherein the one or more filters are inoperable while the breathing hose provides pressurized air supply but provide back-up air supply by filtering outside air in the event, that supplied air through the breathing hose is compromised. In some embodiments, the respirator may further comprise a facepiece and an inhalation check valve; wherein the one or more filters and the inhalation check valve may be located on the facepiece; wherein the inhalation check valve may be biased closed but operable to open upon application of sufficient pressure; wherein the breathing hose may attach to the inhalation check valve to provide supplied air to the respirator; and/or wherein the one or more filters each may comprise a valve that opens based on a drop in supplied air pressure through the inhalation check valve (i.e. when the inhalation valve closes). In some embodiments, the respirator may further comprise a hood and a removable protective cover; wherein the hood does not cover the inhalation check valve, the exhalation valve, and/or the one or more filters; and wherein the protective cover shields the inhalation check valve, exhalation valve, and/or one or more filters from the abrasive blast environment when in place on the facepiece.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 6A illustrates a cross-section view of an exemplary embodiment of an inhalation valve, while

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or art "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Figure 1:
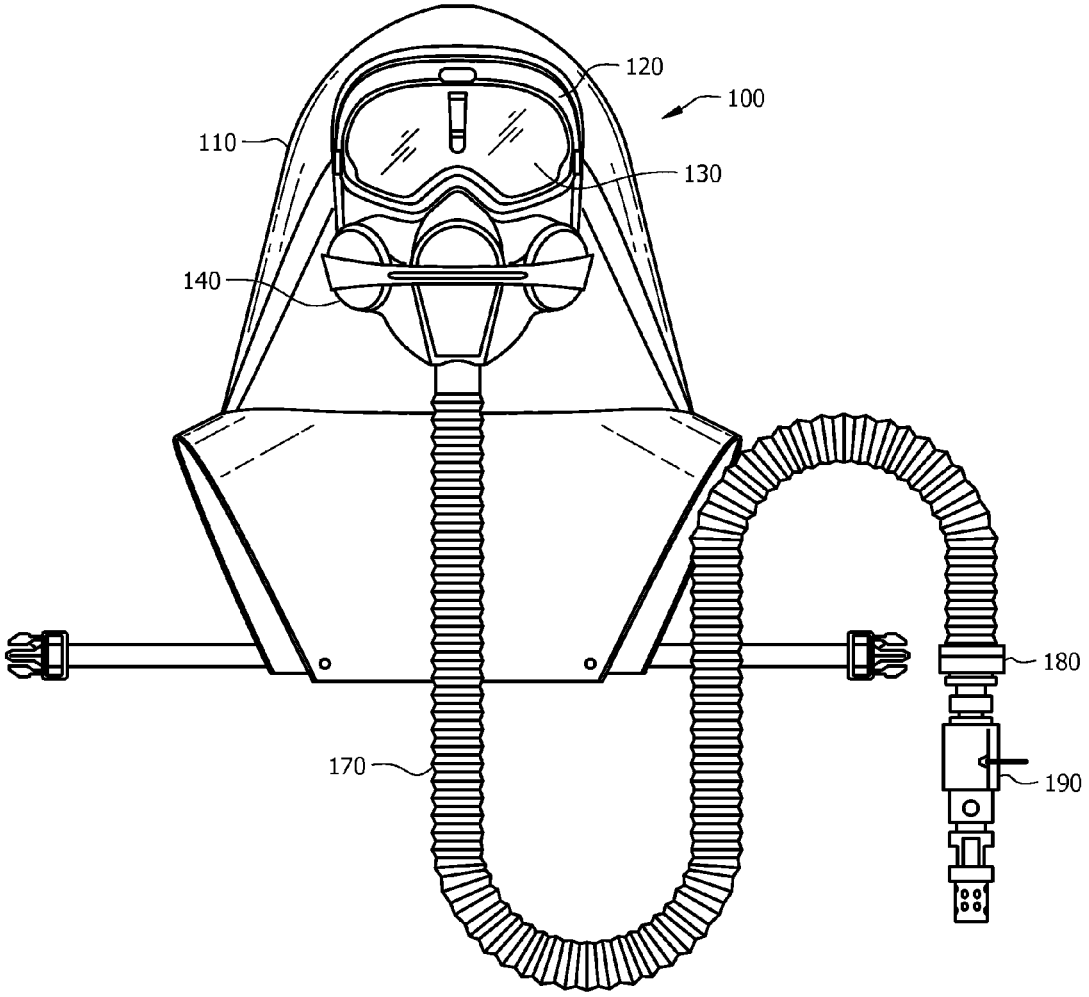
FIG. 1 provides an overview of an exemplary embodiment of an abrasive blast respirator.

FIG. 1 provides an overview of an illustrative exemplary embodiment of a supplied-air respirator, of the sort that might be used during abrasive blasting. The respirator 100 embodiment of FIG. 1 comprises a hood 110 operable to cover and protect a user's head (and optionally shoulders and/or upper chest) from an abrasive blasting environment and a facepiece. 120 operable to cover and protect the user's face. The facepiece 120 of the embodiment of FIG. 1 typically securely attaches to the hood 110, to minimize any possibility that abrasive grit might penetrate the protection offered by the respirator 100. The facepiece 120 typically might have a base lens shielding the user's eyes while providing visibility for performing the abrasive blasting work, and in the embodiment of FIG. 1 an optional lens cartridge 130 or magazine may removably attach to the facepiece 120 to provide additional protection (for example, protecting the base lens of the facepiece from damage during blasting).

The facepiece 120 of the embodiment of FIG. 1 typically may also have one or more elements external to the hood (for greater accessibility and/or ergonomics, for example) that may need protection from the abrasive blasting environment. For example, an inhalation valve, exhalation valve, and/or one or more filters might be located on the facepiece 120. To protect these exposed elements from the abrasive blasting environment, while allowing ready access to the elements (without the need to reposition, reconfigure, move, or partially doff the hood 110, for example), a protective cover 140 might removably attach to the facepiece 120. The protective cover 140 typically may shield exposed elements (which would typically be located underneath (behind) the cover) from the abrasive blasting environment (for example, from abrasive grit blowback).

Since the respirator 100 of FIG. 1 is a supplied-air respirator, it is typically equipped with a breathing hose 170. The breathing hose 170 typically may connect, directly or indirectly, to an air supply line which provides pressurized air (for example from a pump source located away from the abrasive blasting environment so that it provides clean air at pressure in a continuous fashion to the respirator 100). In some embodiments, the breathing hose 170 connects to a muffler housing block 180, which may connect to an optional VORTEX™ device 190 (e.g. a device operable to provide heating and/or cooling of supplied air). In FIG. 1, the air supply line typically might connect to the muffler block 180, the VORTEX™ 190, or to the breathing hose 170.

Figure 2:
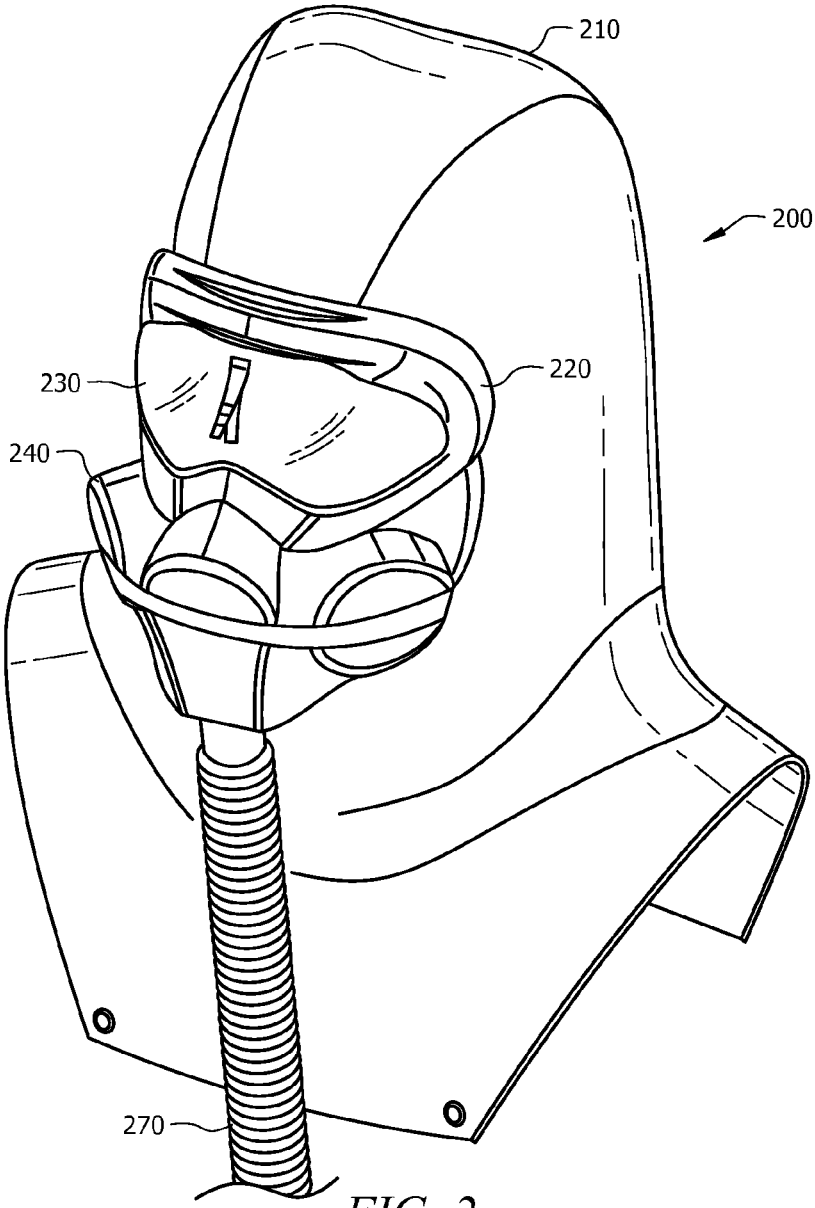
FIG. 2 illustrates a perspective view of an exemplary embodiment of an abrasive blast respirator.

FIG. 2 illustrates another exemplary embodiment of a supplied-air respirator 200 having a hood 210, a facepiece 220, a lens cartridge 230, a protective cover 240, and a breathing hose 270. FIGS. 1 and 2 are merely illustrative, and one or more of the elements or aspects discussed with regard to these or other figures may be optional. Additionally, placement of elements or aspects discussed with regard to these or other figures may be optional, with alternative locations available for alternative embodiments. Persons of skill will understand variations and alternative embodiments, all of which are included in this disclosure.

Figure 3:
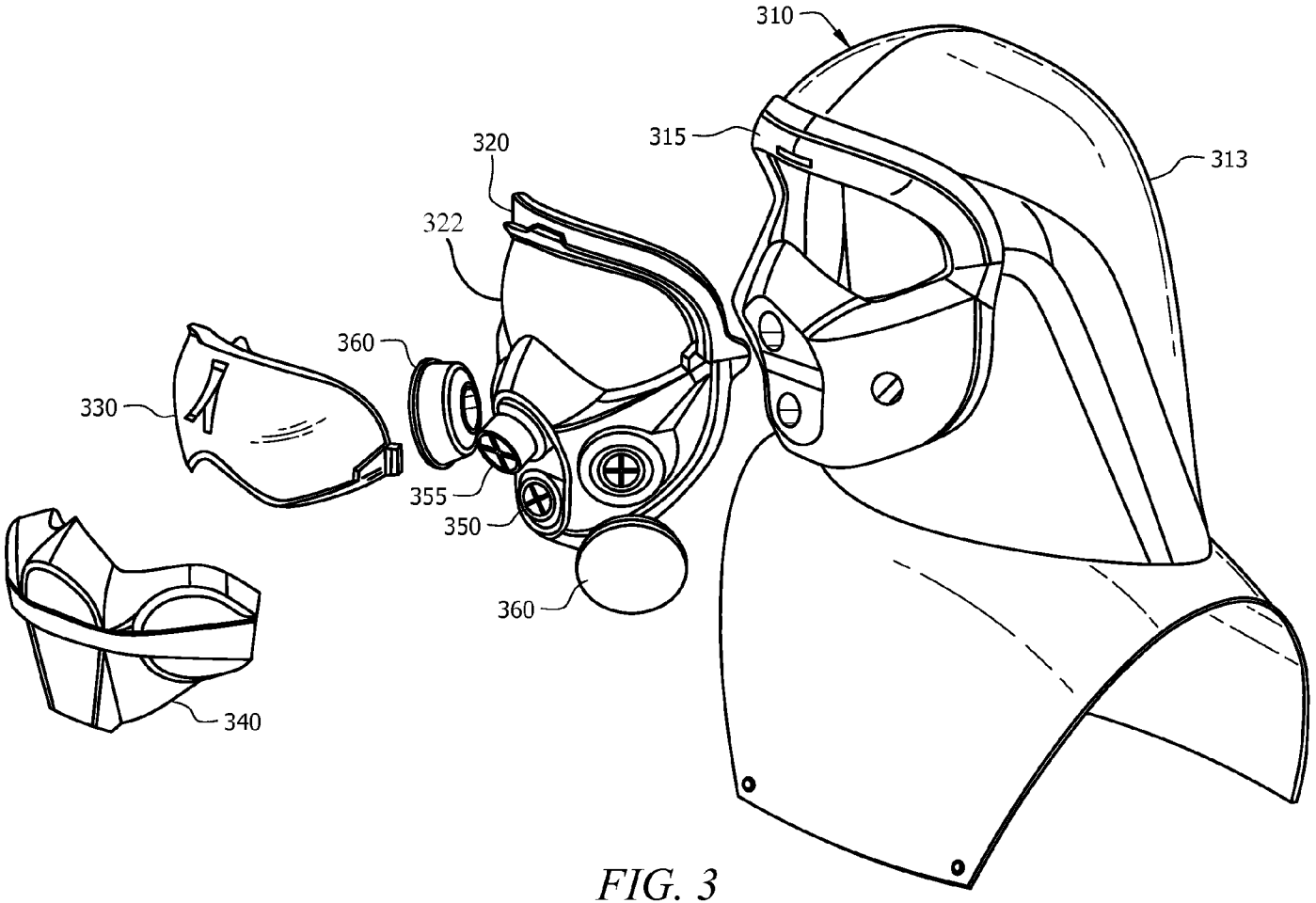
FIG. 3 illustrates an exploded view of an exemplary embodiment of a respirator.

FIG. 3 illustrates an exploded view of an exemplary embodiment of the hood-facepiece assembly of a respirator. In FIG. 3, the hood assembly 310 comprises a hood 313 (typically constructed of a material offering adequate protection from an abrasive blasting environment while also being sufficiently flexible to allow the user sufficient free-range of motion to work and sufficiently lacking in bulk so that it will not impede the user's ability to enter into tight or confined spaces) and a facemask 315. Typically, the facemask 315 is securely attached to the hood 313 to form an integrated unit (assembly 310). Facepiece 320 of FIG. 3 may comprise a base lens 322 (providing adequate field of vision, for example about 100 to about 170 degrees (or in some embodiments, greater than about 160 degrees), while typically also providing one level of protection for the user's eyes), a (supplied-air) inhalation valve 350, one or more filters 360 (operable to filter external air from the abrasive blasting environment sufficiently to purify the air for safe breathing), and an exhalation valve 355. By including both an inhalation valve 350 and one or more filters 360, the respirator may operate as either a supplied-air respirator and/or a purified air respirator. In FIG. 3, the filters 360 are only used in instances when the supplied-air (which enters through the inhalation valve in FIG. 3, for example) is compromised (for example, if the breathing hose is damaged or kinked, or if the breathing hose is disconnected from the air supply line). So for example, if supplied-air pressure is available through the inhalation valve 350, the filters 360 would be inoperable and the user would only breathe supplied-air; if however no supplied-air is entering the respirator through the inhalation valve 350, then the filters 360 of FIG. 3 would become operable and the user would breathe filtered air from the external abrasive blasting environment. Thus, the filters 360 of FIG. 3 provide a back-up air supply, which may improve the safety and utility of the respirator.

In FIG. 3, an optional lens magazine or cartridge 330 may be removably attached to the facepiece 320. The lens cartridge 330 typically might attach to cover the base lens 322 of the facepiece, and typically the lens cartridge 330 would include a plurality of removable lenses. The removable lenses would each shield the base lens, sacrificially protecting it from damage from the abrasive blasting environment. Once the outermost lens of the lens cartridge has been damaged (for example scratched, scuffed, abraded, or dirtied) to a degree that compromises the user's vision, the user may remove the outermost lens to continue working while the next sacrificial lens protects the base lens of the facepiece. Once all of the removable lenses are damaged, the entire lens cartridge 330 may be removed and replaced with a new lens cartridge, for example. In this way, sacrificial outer protective lenses may be removably attached, used, and removed/discarded to protect the base lens of the facepiece (or perhaps in alternative embodiments without a base lens, to protect the user's eyes) from the abrasive blasting environment.

FIG. 3 also employs a removable protective cover 340 which, when in place on the facepiece 320, shields and protects one or more of the inhalation valve 350, exhalation valve 355, and/or filters 360 from the abrasive blasting environment. The removable cover 340 allows for one or more of the inhalation valve 350, exhalation valve 355, and/or filters 360 to be located external to the hood (i.e. without the hood covering them), typically on the front, of the facepiece for better access and/or ergonomics, since they can be protected from the environment, by the protective cover 340.

In FIG. 3, the facepiece 320 would typically be inserted inside the hood 313 and placed in contact with the facemask 315. By having the facemask 315 overlie at least portions of the facepiece 320, at least portions of the facepiece can be protected from the abrasive blasting environment. The facemask of FIG. 3 typically has one or more orifices corresponding to the base lens 322, the exhalation valve 355, the inhalation valve 350, and/or the one or more filters 360, and the facepiece 320 typically might be aligned and press-fit onto the facemask 315 from within the hood 313. Typically, the filters 360 of FIG. 3 may only be applied/attached to the facepiece 320 once the facepiece is in place in the hood (with orifices aligning with the mask 315), since this would allow the filters to help retain the facepiece in place with respect to the hood assembly. Typically, the removable lens cartridge 330 and/or the removable cover 340 of FIG. 3 also would not be attached until after the facepiece 320 has been seated in the hood.

Figure 4:
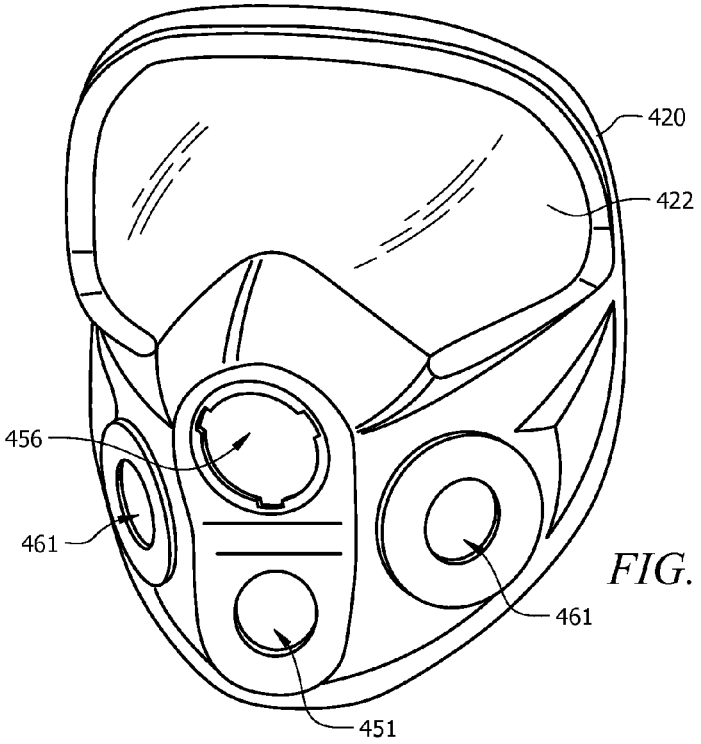
FIG. 4 illustrates an exemplary embodiment of a facepiece base lens element.

FIG. 4 illustrates an embodiment of an illustrative base lens facepiece. The facepiece 420 typically is a unified piece/element, which for example might be formed of molded plastic (for example polycarbonate such as Lexan 103R). The facepiece 420 of the embodiment of FIG. 4 typically comprises a base lens 422, a supplied-air inhalation port 451, a purified (filtered) air inhalation port 461, and an exhalation port 456 (although other embodiments may have less ports, depending on which elements are located on the facepiece). The facepiece 420 might also include optional ridges, tabs, or clips to assist in secure attachment to the hood (as may be discussed in more detail below). The base lens 422 is typically formed of optical grade polycarbonate of sufficient strength to provide eye protection (for example, sufficient to pass ANSI High Impact test). The lens of FIG. 4 may be curved to provide a wider range of vision (greater than 90 degrees). For example, the lens 422 typically provides a field of vision between about 100 and about 170 degrees. In the embodiment of FIG. 4, the lens curvature may provide field of vision of about 160 degrees (or in other embodiments greater than 160 degrees). The facepiece 420 exhalation port 456 is sized and shaped to allow an exhalation valve to be fit and attached to the facepiece (so that exhalation air may exit the respirator effectively); the supplied-air inhalation port is sized and shaped to allow supplied air (for example via a breathing hose directly or via an inhalation valve) to be fit and attached to the facepiece (so that supplied-air may enter the respirator effectively); and the purified air (filter) inhalation port(s) 461 are sized and shaped to allow purifying filter(s) be fit and attached to the facepiece. These ports allow the inhalation valve, exhalation valve and/or filters to be removably attached to the facepiece 420 of FIG. 4.

Figure 5:
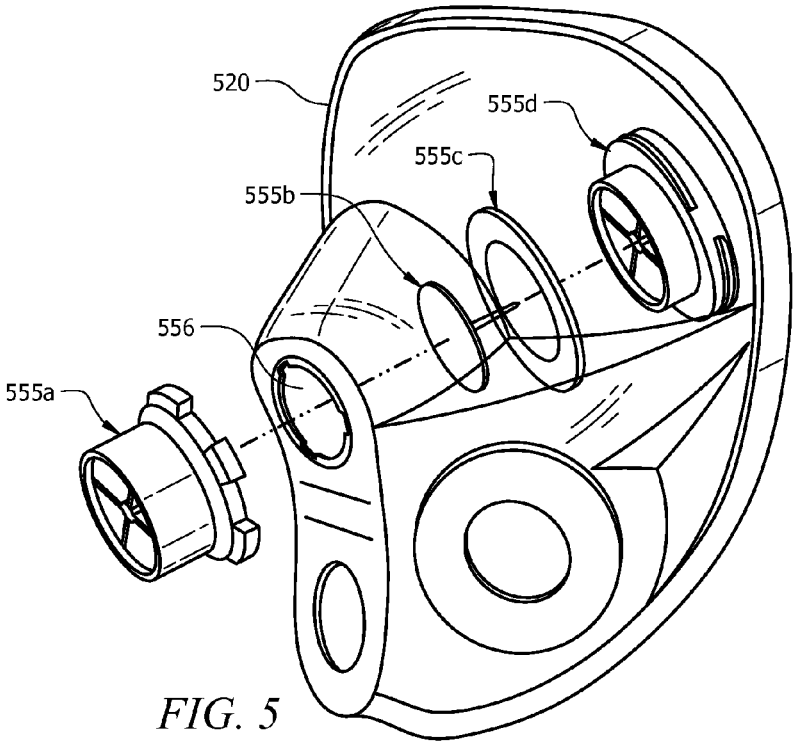
FIG. 5 illustrates an exploded view of an exemplary exhalation valve, showing it with respect to the facepiece base lens element.

FIG. 5 illustrates an exemplary embodiment of an exhalation valve, showing how it might be assembled to attach to the exhalation port 556 of facepiece 520. Generally speaking, the exhalation valve may be operable to allow exhalation air (from a user wearing the respirator) to exit the respirator, while not allowing air from the external environment to enter the respirator. So for example, the exhalation valve might be operable to remain closed except when sufficient fluid (air) pressure is exerted upon it from within the facepiece 520 (as for example, when a user wearing the respirator exhales). So typically the exhalation valve might be biased closed, but the biasing force (provided by a spring for example) might be overcome by the force of a user's exhalation of air. The exhalation valve of FIG. 5 comprises a valve element 555*b* that interacts with a seal element 555*c*. The valve and seal typically may be located with a valve housing 555*d*, and the valve housing of FIG. 5 attaches to a valve cover 555*a*. The valve cover 555*a* of FIG. 5 is located external to the facepiece 520, while the valve 555*b*, seal 555*c*, and valve housing may be located inside (within) the facepiece. In FIG. 5, the valve cover and valve housing attach via screw threads, and by attaching these elements (with one inside the facepiece and one outside the facepiece) together, the exhalation valve may be removably attached to the facepiece. In other embodiments, a one-way membrane might be used to allow airflow of exhalation air out of the respirator while preventing airflow into the respirator. Persons of skill will appreciate that a variety of exhalation valve designs might provide the functionality. Typically, the exhalation valve might meet NIOSH resistance requirements.

While in some embodiments the exhalation valve might be located under the hood of a respirator (to protect the exhalation valve from the damaging abrasive blasting environment), such a location might complicate accessibility to the exhalation valve. For example, when donning a respirator, the user might typically perform a positive pressure seal check (test) by covering the exhalation valve by hand and exhaling deeply (attempting to feel if any air exits the respirator due to a poor seal around the user's face). Thus accessibility of the exhalation valve may improve the ergonomics of positive seal testing of the respirator. Furthermore, locating the exhalation valve under the hood of a respirator might require that, for performing a seal check, the hood be moved or reconfigured from its standard configuration for use in abrasive blasting. Such a location might increase incidents of unsafe respirator hood usage, since additional user error (for example the user forgetting to reconfigure or reposition the hood prior to blasting) might likely be introduced. Additionally, a location on the front of the facepiece under the lens provides improved visual access, with better view aiding in the seal check for example. If the exhalation valve were located under the hood, the user might have to rely on blind feel to perform the check; visual cues may simplify the process. Thus, the respirator of FIG. 3 typically may locate the exhalation valve on the front of the facepiece external to the hood, for improved ergonomics (and accessibility) and ease of seal checking.

Figure 6A:
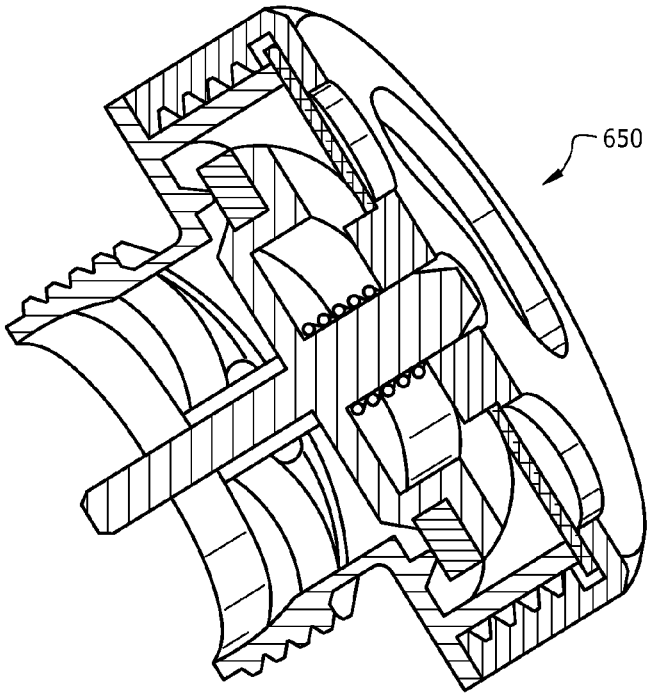
Figure 6B:
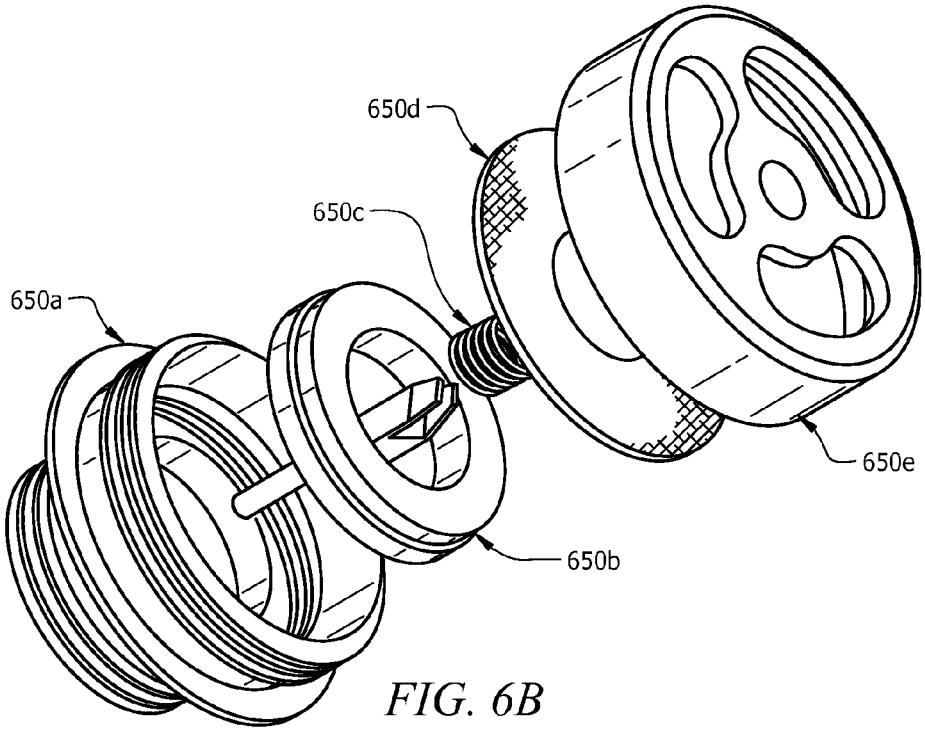
FIG. 6B illustrates an exploded view of the exemplary inhalation valve.

FIGS. 6A and 6B illustrate an exemplary embodiment of an inhalation valve, and more specifically an inhalation check valve (although a variety of inhalation valves may provide functionality). The purpose of the inhalation valve is to allow supplied-air under pressure to enter the respirator, while preventing air from entering (or leaving via the supplied-air inhalation valve port) the respirator (through the supplied-air inhalation port) if there is a significant pressure drop (which might for example indicate that the supplied-air has been compromised). Thus, if there is no supplied-air entering the inhalation valve (for example, if the breathing hose or air supply line has become disconnected, or if the line or tube has been kinked or damaged), the inhalation valve 650 of FIG. 6B would be operable to automatically close. And if there is a significant pressure drop in the supplied-air (which might indicate that the hose or line has a rupture or hole and might be contaminated by the abrasive blasting environment, for example), the inhalation valve 650 of FIG. 6A would automatically close. But so long as the supplied-air pressure to the inhalation valve 650 is sufficient (to indicate, for example, that the supplied-air has not been compromised), the inhalation valve will remain open, allowing supplied-air to enter the respirator.

The inhalation valve 650 of FIGS. 6A and 6B comprises a seal 650*b* and a biasing element (such as spring 650*c*) that biases the valve closed (in this instance by biasing the seal element 650*b* to press against housing 650*a*. In the embodiment of FIG. 6B, the spring 650*c* is seated on a stem projecting from the seal element 650*b*, and the spring pushes off from the cover 650*e*. The embodiment of FIG. 6B also includes an optional porous airflow element 650*d* (for example, a nonwoven polyester such as felt) located in proximity to the exit to the inhalation valve 650 (for example near the inner cover 650*e*) and operable to alter the airflow exiting the inhalation valve to minimize noise. For example, the porous airflow element 650*d* may change the turbulence characteristic of air exiting the inhalation valve 650, for example reducing turbulence in some embodiments. Additionally, the inhalation valve 650 might be designed to minimize flutter. In FIG. 6B, the cover and the housing typically may securely (but removably) attach to one another via screw threads, for example. Persons of skill will appreciate that a variety of inhalation valve designs might provide functionality. Typically, the inhalation valve in FIG. 6B might meet NIOSH restriction requirements.

Typically, the inhalation check valve 650 of FIG. 6B may be biased closed with sufficient force so that at least about 1 psi (or in some embodiments at least about 2 psi) of supplied-air pressure must enter the inhalation valve from outside the respirator to open the valve and allow supplied-air from the breathing hose to enter the respirator. For example, the biasing force may be sufficient so that it will not be overcome by a user's inhalation suction force, with some greater force (typically provided by supplied-air pressure for example) being required to open the inhalation valve. So when the breathing hose provides sufficient supplied-air pressure (typically at least about 1 psi, or in alternative embodiments, at least 2 psi), the inhalation valve is automatically opened by that pressure and allows airflow into the respirator. If however, the supplied-air pressure entering the inhalation check valve drop under the set psi level (indicating for example that the supplied-air has been compromised), then the inhalation check valve of FIG. 6B would automatically close to seal the respirator (from air entering through the inhalation valve).

While the inhalation valve might be located anywhere on the respirator, in the embodiment of FIG. 3, for example, the inhalation valve typically may be located on the front of the facepiece. And in the embodiment of FIG. 3, the inhalation valve may be located below the base lens of the facepiece, providing better visual cues (for example when removing the breathing hose). Such a location may tend to improve ergonomics, reducing user fatigue and reducing incidents of breathing hose snags or kinks. Additionally, placing the inhalation valve on the facepiece improves user safety by ensuring that no contaminated air could enter the respirator in the event of a breach of the breathing hose. If, for example, the inhalation check valve were instead located at the bottom end of the breathing hose (for example at the point of attachment of the breathing hose to the air supply line), then a breach of the breathing hose might lead to inhalation of contaminated air (for example containing grit particulates from the abrasive blasting environment). Thus, locating the inhalation valve on the facepiece improves user safety. Unfortunately, the inhalation valve itself generates some noise (for example, due to the supplied-air exiting the inhalation valve), and locating the inhalation valve on the facepiece moves that noise source close to the user. To reduce this noise source, Applicants have introduced a porous airflow element, for example, felt, to alter the airflow exiting the inhalation valve to minimize noise.

Furthermore, while the inhalation valve might be located under the hood in some embodiments (to offer protection from the environment), in the embodiment of FIG. 3 the inhalation valve is located external to the hood. Such a location may improve ergonomics and user comfort, since for example movement of the breathing hose (for example, when the user turns his head) would not be restricted by the hood. Furthermore, location of the inhalation valve outside of the hood may simplify attachment of the breathing hose to the respirator.

The one or more filters 360 of FIG. 3 are typically located on the front of the facepiece as well. While filters may not be required in some embodiment, in FIG. 3 filters are included to provide back-up air supply for additional safety. Typically sufficient size and/or number of filters are used to ensure that the user may breathe filtered (purified) environmental air as a back-up source without excess effort. The filter(s) typically are sufficient to purify external air in an abrasive blasting environment, at least for sufficient duration to allow a user to safely escape the environment in an emergency. These filters in FIG. 3 typically may be formed of HEPA (High efficiency Particulate) filtering material encapsulated in High Impact styrene (secured within a housing), and may be removably attached to the facepiece. For example, P100 cartridge filters made by North/Honeywell could be used in some embodiments. Persons of skill will appreciate that a variety of filter designs might provide functionality. Typically, either the filters 360 or the purified-air inhalation port (to which the filters connect to the facepiece) may comprise a valve (for example a flap valve) that only opens under negative pressure (for example, when a user inhales in the absence of supplied-air pressure). So, when the breathing hose is providing supplied-air pressure to the respirator through the inhalation valve, the filter valve would be closed (such that the user would only get air from the supplied-air source, and would not draw air into the respirator through the filters). However, if the supplied-air is compromised (such that the inhalation valve closes), then the filter valve(s) would be operable to open based on the suction force of the user's inhalation. The filter valve(s) typically should upon sufficiently easily under the suction force of user inhalation (when there is no positive pressure supplied) that the user's breathing will not be labored.

The filters and the inhalation valve of FIG. 3 tend to work as a system, so that the respirator of FIG. 3 may serve as a supplied-air respirator under most conditions, but serve as a purified (filtered) air respirator as a back-up in instances when the supplied-air is unavailable or otherwise compromised. In other words, the combination of the inhalation valve and the filters (with filter valves) allows the respirator of FIG. 3 to provide supplied-air, while automatically switching to filtered air via the filters if the supplied-air is compromised. The combination of the inhalation valve and the filter valve work together to automatically provide back-up filtered air when needed, while disabling/disengaging the filters when the supplied-air is available. This effect may be improved by locating the inhalation valve on the facepiece, since there would be less air volume for the user to move with inhalation, for example. By providing the filter back-up (with automatic activation), user safety can be improved. So for example, if supplied-air is compromised, the user may have time to leave the environment and/or to correct the problem (for example, unkinking the breathing hose or air supply line) due to the available back-up air supply provided by the filters. And by only using the filters when needed in back-up (for example, emergency) situations, the filters can have a longer effective lifespan (since filters may tend to have fairly short lifespans when used in abrasive blasting environments).

While the filter(s) could be located anywhere on the respirator, in the embodiment of FIG. 3, the filters are located on the front of the facepiece, external to the hood. Typically, the filters may be located beneath the base lens, providing visual access. This placement provides ready access for performing seal checks. For example, users might typically perform a negative seal check by covering the filters by hand while the inhalation check valve is closed and inhaling. Such a check is easier to perform if the filters are located external to the hood. Also, by locating the filters, the exhalation valve, and/or the inhalation valve on the front of the facepiece, a single removable cover might be operable to shield one or more of these elements.

So for example, in FIG. 3 a single protective cover 340 might be removably attached to the (front of the) facepiece to shield the filter(s), the exhalation valve, and the inhalation valve. The cover 340 of FIG. 3 would not provide an airtight fit to the facepiece, since the filters would need to be able to draw in external air, but would protect the elements from grit blowback, for example. The cover 340 would be removable so that it could be taken off for performing testing, seal checks, and/or cleaning, but would be operable to be removably secured to the facepiece for use during blasting. In FIG. 3, the cover 340 might contain a plurality of tabs operable to snap onto the filters and or facepiece (or other elements), for example. In other embodiments, a plurality of removable covers might be used to protect various elements external to the hood, in which instance a sealed removable cover might be used to shield the inhalation valve for example, with the filter(s) and/or exhalation valve cover(s) typically not being sealed.

Figure 7:
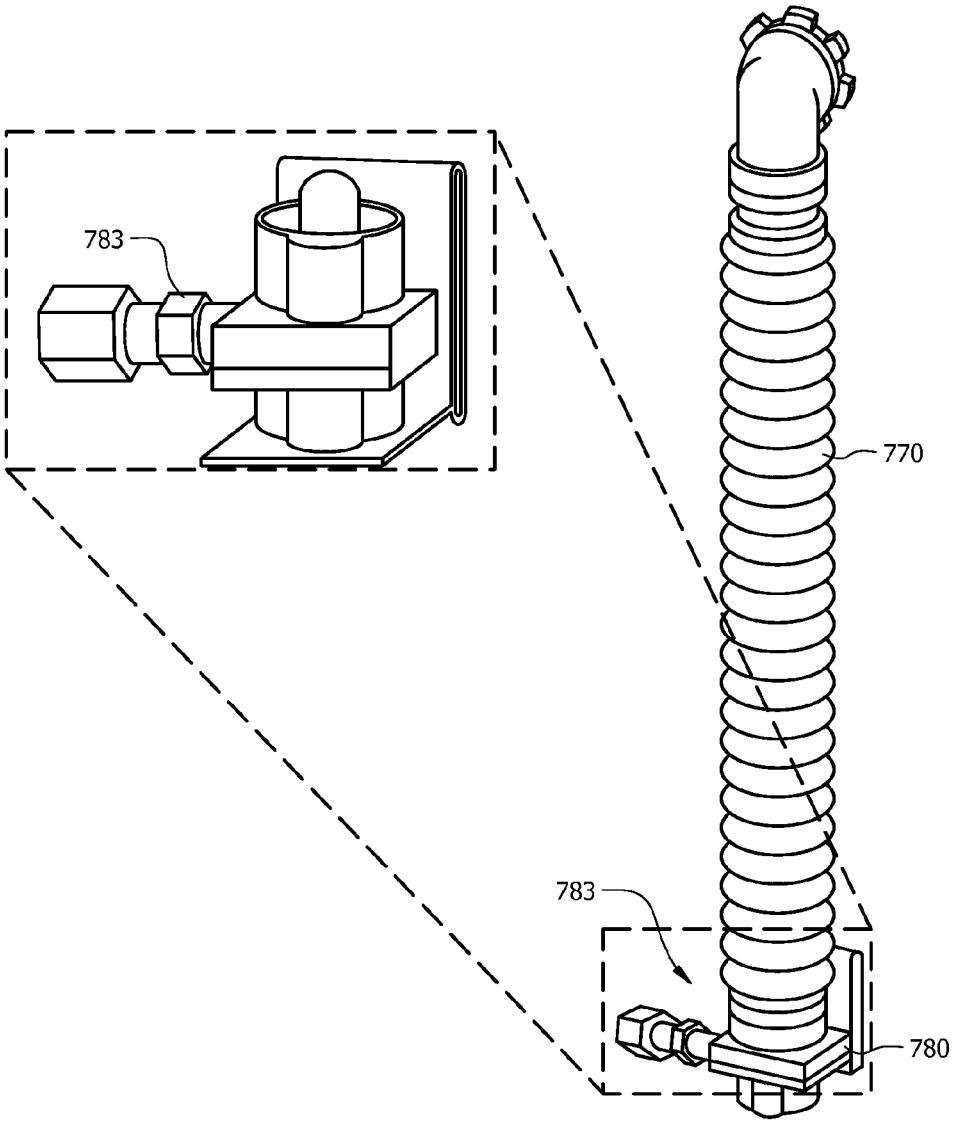
FIG. 7 illustrates an exemplary embodiment of a breathing hose with muffler housing block assembly.

Supplied-air is typically provided to the respirator facepiece via a breathing hose, as shown in FIG. 1. FIG. 7 illustrates an exemplary embodiment of a breathing hose assembly. The breathing hose 770 typically connects at its bottom end to an air supply line (which typically brings pressurized air from a pump located outside the abrasive blast environment), while the top end of the breathing hose 770 typically connects to the inhalation valve on the facepiece. At its top end, the breathing hose may comprise an attachment element operable to removably attach to the inhalation valve of the facepiece of the respirator. In the embodiment of FIG. 7, the attachment element is a swivel assembly, such that the breathing hose may removably attach to the inhalation valve in a way that allows the breathing hose to swivel or pivot (which may improve the user's head mobility and/or reduce stretching of the breathing hose due to user movement). In FIG. 7, the top end of the breathing hose is attached to the swivel assembly using a clamp. The breathing hose 770 itself is of a crush-proof design, typically having a corrugated surface and being constructed of a durable material like EPDM (for example, material able to sustain direct blast abrasive particles).

Typically, the breathing hose assembly should also be burst-proof, employing a design that would minimize chances that the hose might burst under excess pressure. While a spring might be used inside of the breathing hose in some embodiments to provide structural support to improve crush and/or burst issues, such spring support might add considerably to the weight of the breathing hose (impacting ergonomics and comfort for a user by weighing down the head and straining the neck). So in the embodiment of FIG. 7, the breathing hose 770 does not include a spring (or other internal structural support); rather, a pressure relief valve 783 is used to minimize burst concerns. The pressure relief valve may be set to vent air and reduce pressure in the breathing hose 770 if the pressure exceeds a safe level, for example less than the burst pressure of about 30 psi for a typical breathing hose, between about 5 and about 25 psi, or in some embodiments about 10 psi. In the embodiment of FIG. 7, the pressure relief valve 783 may be located at the bottom end of the breathing hose (in proximity to the interface between the breathing hose and the air supply line).

Figure 8:
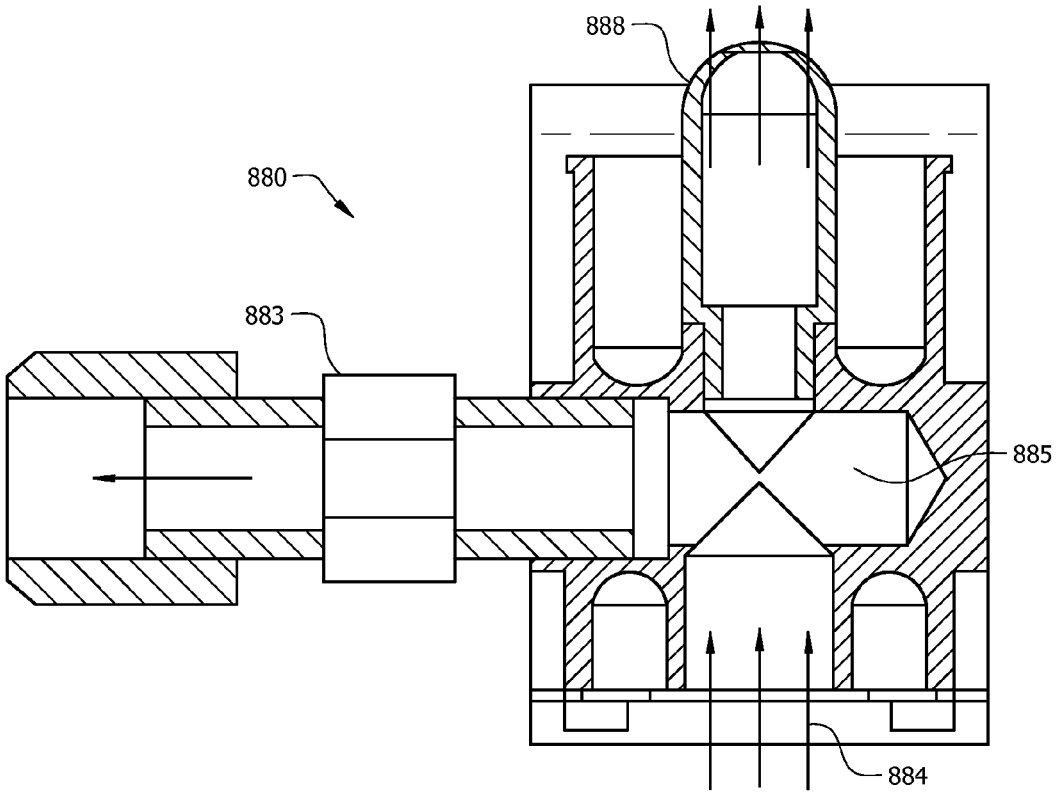
FIG. 8 illustrates an exemplary embodiment of a muffler housing block with optional pressure relief valve.

In FIG. 7, the pressure relief valve 783 may be part of a muffler housing block 780 located at the bottom end of the breathing hose 770. The muffler housing block 780 typically is located at the interface of the breathing hose 770 and the air supply line (or optionally the VORTEX™ (e.g. a device operable to heat and/or cool supplied air) through which the air from the air supply line flows). The top end of the housing block 780 may receive the bottom end of the breathing hose 770, typically with a clamp (removably) affixing the elements. The bottom end of the housing block 780 is designed to removably attach to the air supply line and/or VORTEX™, typically by screw thread attachment (since this attachment may need to be broken and formed fairly often during work, and screw threads provide a secure form of attachment that can be easily coupled and uncoupled). FIG. 8 illustrates an exemplary embodiment of a housing block 880 in cross-section, showing the inlet 884 (through which air from the air supply line and/or VORTEX™ may enter the housing), the outlet 888 (through which the air flows into the breathing hose), and the chamber 885 linking the inlet and the outlet (and allowing air to flow through the housing block). The chamber of FIG. 8 provides a direct, linear path between the inlet and the outlet, to minimize noise generation due to turbulence. In FIG. 8, the optional pressure relief valve 883 branches off of the chamber 885. The housing block of FIG. 8 also may optionally include a muffler element, which typically might fit over the outlet 888. For example, the muffler element might be a cylindrical cap with a closed end (that fits snuggly over the outlet conduit) formed of porous plastic, for example polypropylene. The muffler tends to reduce noise generated from the housing block. In some embodiments, a separate muffler element may not be needed, however, if the chamber 885 can be sized and tuned appropriately during design to minimize noise, and/or in other embodiments, one or more baffles in the chamber might be used to minimize noise.

Additionally, in some embodiment a porous airflow element, for example a nonwoven polyester material such as felt) might be located in proximity to the interface of the outlet 888 of the housing block with the breathing hose. For example, the porous airflow element (not shown) might be located in the bottom end of the breathing hose. This porous airflow element may alter the airflow characteristics entering the breathing hose to reduce noise generation within the breathing hose. For example, Applicants have found that without using such a porous airflow element, the breathing hose may whistle under some pressure loads, but that the porous airflow element reduces or eliminates this whistling effect. Typically, the porous airflow element at the muffler housing block might be formed of the same material as the porous airflow element in the inhalation valve (as discussed above). While felt might be used in the embodiment of FIG. 8, other porous airflow materials, such as open cell foam for example, might be substituted, so long as they alter the airflow characteristic appropriately (typically minimizing turbulence for example) without unduly restricting airflow. And the muffler housing block 880 of FIG. 8 might also optionally include a belt clip for attachment to a user's belt, (to secure the bottom of the breathing hose and the air supply line for ergonomics, for example).

Figure 9:
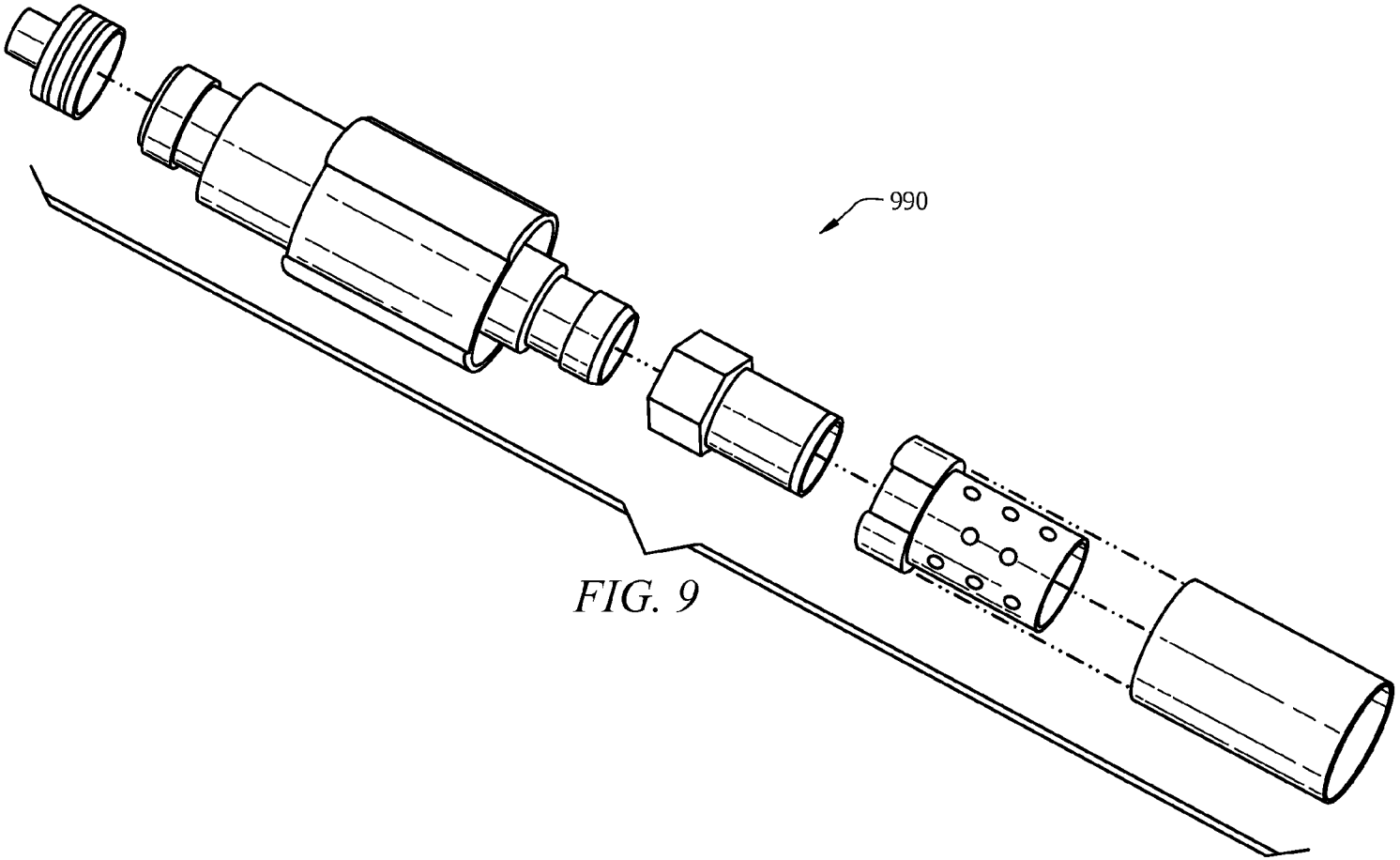
FIG. 9 illustrates an exemplary embodiment of an optional vortex assembly.

FIG. 9 illustrates a Vortex tube assembly 990, which houses a VORTEX™ element (e.g. a device for heating and/or cooling supplied air). VORTEX™ is a known off-the-shelf element for cooling and/or heating supplied-air. The Assembly of FIG. 9 may provide coupling elements, for example screw threads, to allow the VORTEX™ (or other such device for heating and/or cooling supplied air) to be coupled to the breathing hose and/or housing block and the air supply line (so that supplied-air from the air supply line passes through the VORTEX™ before entering the breathing hose and/or housing block). It also may provide a housing that shields the VORTEX™ from the abrasive blasting environment, a temperature/flow control valve, an exhaust muffler, and/or muffler guard. When in place between the air supply line and the breathing hose, the optional device for heating and/or cooling supplied air (e.g. VORTEX™) may improve user comfort by altering the temperature of the air flowing to the user. The VORTEX™ generates noise, however, and one or more of the noise reduction elements discussed above may be needed to allow it to be used while satisfying governmental regulations.

Figure 10:
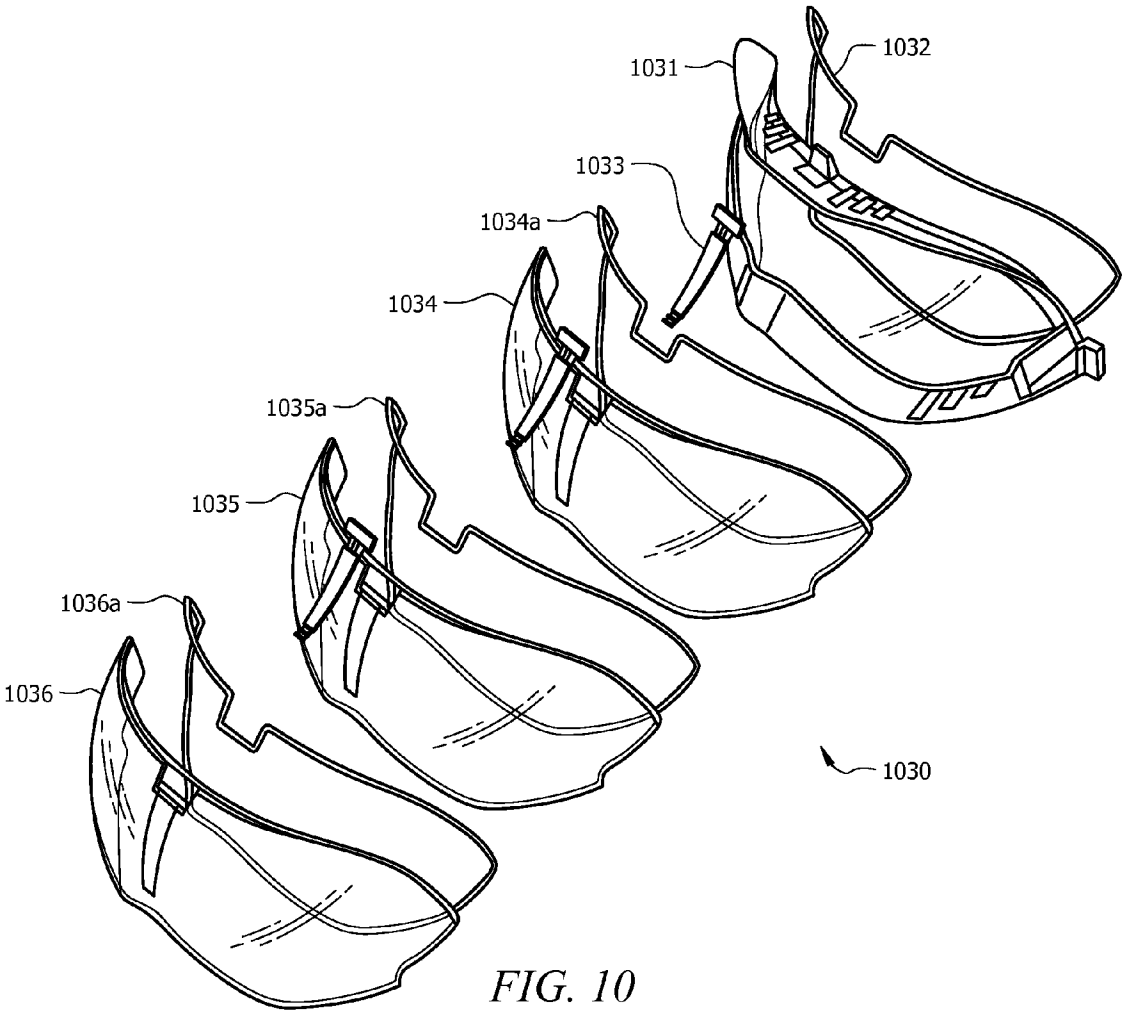
FIG. 10 illustrates an exemplary embodiment of an optional lens magazine or cartridge.

As briefly discussed with regard to FIG. 3, the base lens of the facepiece may require sacrificial protection to keep it from being damaged by the abrasive blasting environment. In FIG. 3, a lens cartridge (or magazine) may be used to provide this protection. FIG. 10 illustrates an exemplary lens cartridge 1030 that may be removably attached to (the base lens of) the facepiece. The lens cartridge 1030 of FIG. 10 typically comprises a carrier lens 1031 and one or more removable covering lenses. Typically, the one or more removable covering lenses are removably attached to the carrier lens 1031, and often they might include a tab 1033 on the front to assist in removal. In FIG. 10, the tab is designed to allow one-handed removal by a gloved hand. Additionally, a gasket, seal material (shown applied to the perimeter of the inner surface of each removable covering lenses as 1036,*a*, 1035*a*, and 1034*a* for example) might be used between the lenses in some embodiments, to prevent grit from the abrasive blast environment from entering between the lenses. The gasket seal material might for example be UV curable polyurethane, placed on the inner surface of the removable covering lenses, typically about the perimeter, and cured to form a secure (durable) attachment to the inner surface. The material would form a seal with the outer surface of the adjacent removable covering lens by contact, but that seal might typically be only tacky rather than secure and durable, allowing the gasket seal to be removed in its entirety (without leaving substantially any portion behind on the outer surface of the adjacent lens). In other words, the gasket seal is designed to stay firmly attached only to the inner surface of the outermost of an adjacent pair of removable covering lenses, so that when that outermost lens is removed, substantially the entirety of the gasket seal is removed with it.

In FIG. 10, the carrier lens 1031 includes a protective lens element, and a carrier frame designed to removably hold the removable covering lenses in place on the carrier lens 1031 (so that the removable covering lenses might be stacked on the exterior of the carrier lens). In the embodiment of FIG. 10, the outer removable covering lenses might be attached to the carrier frame of the carrier lens by corresponding (snap fitting) tabs (projections) and slots (with the carrier frame typically having a series of slots at different depth locations to receive the projection tabs of the various covering lenses). In FIG. 10, the carrier lens 1031 may also include a gasket 1032, typically a more substantial gasket of rubber or some similar material for example, for sealing interaction with the base lens of the facepiece of the respirator. And in FIG. 10, the carrier lens 1031 is designed to removably attach to the respirator facepiece, typically to cover the base lens. Such removable attachment might be by snap fitting elements as well, for example with corresponding projection tabs (or teeth) and slots (or receiving elements) on the carrier lens perimeter and the facepiece. This approach allows for easy attachment and removal of the lens cartridge 1030 to the facepiece, even with a gloved hand, and for example does not require the user to maneuver or manipulate a gasket on the facepiece itself.

The carrier lens typically may hold a stack of three or four removable covering lenses (which can be removed when vision is too impaired to allow the worker to be able to see to continue work in the abrasive blasting environment). In FIG. 10, for example, the carrier lens 1031 may hold three removable covering lenses, an outer lens 1036, a middle lens 1035, and an inner lens 1034. Typically, these lenses are curved to provide a wide field of vision (which can be helpful economically), typically greater than about 100 degrees but less than about 180 degrees. For example, in FIG. 10 the lenses typically are curved to provide about 160 degrees of vision, or in some embodiments greater than about 160 degrees of vision (such as between about 160 and 180 degrees). And in FIG. 10 the lenses are typically formed of impact resistant optical material (providing sufficient protection to meet governmental regulations and or ANSI high impact and/or optical requirements, for example), for example a molded polymer such as polycarbonate. And in some embodiments, the lenses may be coated to provide additional protection from the abrasive blasting environment and/or blowback (for example using Uvex Hardcoat).

This lens cartridge system, when used in place on a facepiece having a base lens, provides the two layers of protection required by some governmental regulations (by having the base lens and at least the carrier lens in place for protection), allowing the respirator to be used without conventional eye protection (such as safety glasses) being worn under the facepiece (thereby improving ergonomics and comfort for the user, although embodiments may allow usage of glasses such as safety or prescription glasses as well). In use, the lens cartridge system 1030 of FIG. 10 may be snapped onto the base lens of the respirator. Then as the outer lens 1036 becomes damaged by the abrasive environment (such that vision is impaired), the user may snap that outer lens out (removing the damaged lens to provide clear vision through the middle lens). The user may then continue working in the abrasive blast environment until the middle lens 1035 becomes too damaged. Once vision is impaired due to damage to the middle lens 1035, the user may snap the middle lens out (for example, removing it by pulling on the tab affixed to the front of the lens). Then the user may continue working in the abrasive blast environment (with the inner lens offering protection). Once the inner lens 1034 becomes damaged, the user may remove it (by for example pulling the tab to snap it off of the carrier lens), and then continue working with, the carrier lens still in place to protect, the base lens of the facepiece (and providing two layers of eye protection). Once the carrier lens becomes too visually damaged, the user can temporarily stop blasting and remove the carrier lens (by for example pulling on tab 1033 until the carrier lens snaps off of the base lens). The user may then removably attach a new lens cartridge (with a new carrier lens and stack of outer removable covering lenses) to the facepiece and then continue working. This system allows for quick and easy sacrificial lens protection, so that work disruption can be minimized while the base lens and/or user's eyes are protected from damage. So while the lens cartridge system is an optional element, it may add to the utility of the respirator.

Figure 11:
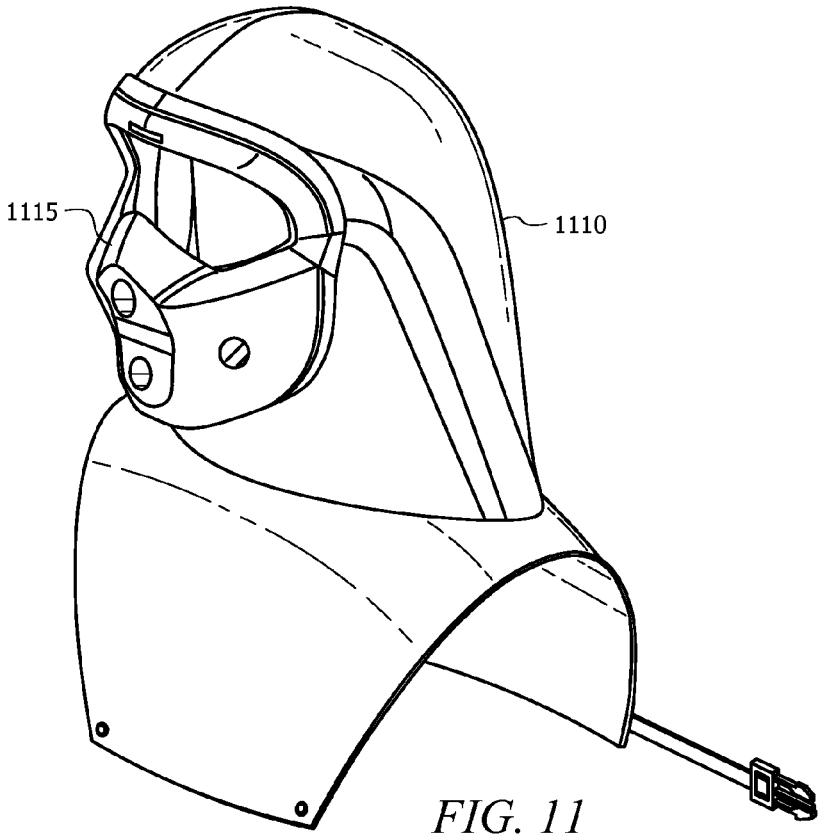
FIG. 11 illustrates an exemplary embodiment of a hood assembly.

While the facepiece of the respirator might function independently in some environments and/or for some uses, typically in the abrasive blasting environment it is used in conjunction with a protective hood covering the user's head. As described above with respect to FIG. 3, the hood assembly typically may comprise a hood (for covering portions of the user's head (such as the top, sides, and back of the head), and possibly portions of the user's shoulders and chest) and a protective mask (for covering portions of the user's face). FIG. 11 illustrates such a hood 1110 and mask 1115, which in FIG. 11 are securely attached to form an integral whole. The protective hood assembly typically functions to offer protection for more of the user's vital or sensitive areas than a facepiece alone might protect (for example, not just the eyes, nose, and mouth, but also the ears and possibly the hair, scalp, neck, etc.) and/or additional portions of the user that are typically subject to the majority of grit blowback during abrasive blasting. Additionally, the mask may serve to provide some protection to the facepiece (typically shielding portions of the facepiece that are not otherwise covered and/or that do not require an opening to accommodate some functional element), while in some instances helping to secure the facepiece to the hood.

The hood 1110 of FIG. 11 is typically is constructed of a lightweight (for example, approximately 17 ounces per square yard or less), flexible material (such as a fabric) that is durably resistant to the abrasive blasting environment. Typically, the hood material may have excellent abrasion resistance, so for example it might be capable of resisting a direct abrasive blast for 15 minutes at six inches. For example, the hood might be formed of polyester reinforced urethane or Hypalon (chlorosulfonated polyethylene). And in some embodiments, the hood might be designed with a shape to accommodate hearing protection, such as earmuffs for example. While some embodiments could include a helmet, the hood 1110 of FIG. 11 typically does not contain any rigid and/or bulky head protective elements, such as a helmet, and the entire respirator system typically would not be used with any rigid and/or bulky head protection elements. The rigidity and bulk of a helmet, for example, might restrict user mobility and/or access to tight or confined spaces. In shipyard settings, for example, abrasive blasting often takes place in tight or confined spaces, and the respirator must allow the user to enter into these spaces to perform the work. Thus, the respirator of FIG. 1, for example, does not include rigid and/or bulky head protection. Rather, the head covering protective element is only a hood 1110 that is entirely flexible. The hood of FIGS. 1, 2, and 11 typically may be contoured to be fairly close fitting, with a design that does not flare out from the user's body too much (since that might allow the hood to become caught or entangled during usage, and/or since a close fit may help reduce the amount of grit that enters the hood). As discussed above, however, in some embodiments the head portion of the hood might not fit too snuggly to provide, room for hearing protection. In some embodiments, as shown for example in FIG. 11, the hood may include one or more straps that may clip the front and back of the hood together, typically under the user's arms.

Figure 12:
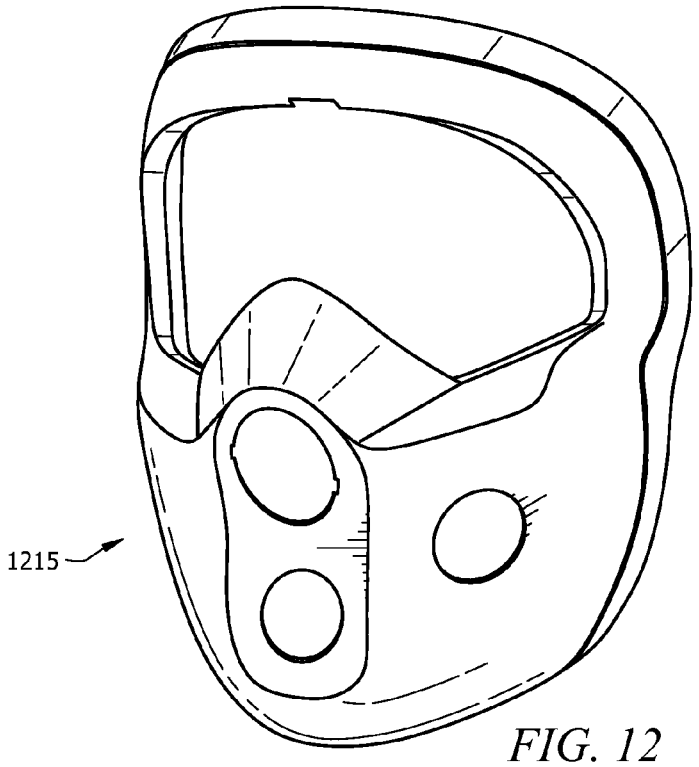
FIG. 12 illustrates an exemplary embodiment of a protective face mask for use within the hood assembly.

FIG. 12 illustrates an exemplary embodiment of a protective mask element 1215 (of the sort typically used with a hood to form a hood assembly, as discussed above). The mask 1215 is designed to fit over the facepiece, typically shielding at least portions of the facepiece from, abrasive blast environment. Typically the mask 1215 might include one or more apertures corresponding to one or more elements on the facepiece. For example in FIG. 12, the mask 1215 comprise an aperture for the base lens, an aperture for the inhalation valve, an aperture for the exhalation valve, and one or more apertures for the filters (depending on the number of filters). In some embodiments, the attachment of one or more such elements to the facepiece (when the facepiece is in place with the mask) may help secure the facepiece to mask and, therefore, the hood assembly. The mask 1215 of FIG. 12 may typically be constructed of a lightweight material that is durably resistant to the abrasive blasting environment (offering excellent abrasive resistance), and often particularly designed to protect the facepiece from direct blast. For example, the face mask 1215 may be made of a material that is capable of resisting direct abrasive blast for 15 minutes at six inches. An example of a material that might be used to form an exemplary mask might be a rubbery material such as TPU (thermoplastic polyurethane) or similar material. The protective mask 1215 also typically may be shaped to correspond closely with the shape of the facepiece, and often may include attachment elements that mesh with corresponding attachment elements on the facepiece, such as slots, grooves, notches, ridges, flaps, tabs, etc. So for example, the lens aperture of the mask 1215 may include one or more attachment elements designed to interact with corresponding elements on the facepiece base lens to help secure the facepiece to the mask, and thereby to the hood. This attachment is typically sufficient to prevent and or greatly reduce infiltration of grit between the mask and the facepiece.

The mask and hood are typically joined into an integral whole hood assembly, and in FIG. 11 the mask 1115 is securely (typically permanently) attached to the hood 1110. Typically, the flexible fabric elements forming the hood may be RF welded or fused together (although other joining means such as sewing may function, so long as they do not allow infiltration of grit into the hood). Sewing may be disfavored in some instances, however, since the abrasive environment tends to be rough on stitching, perhaps resulting in durability issues. The mask 1115 may be welded or fused to the hood as well (if the materials permit such joining means), but in the embodiment of FIG. 11 the mask 1115 is sewn onto the hood to form a durable attachment. To protect the stitching of this joint, the mark and/or hood may include one or more flaps or protective overhangs designed to cover the stitching when the hood assembly is in use (shielding the stitching from the abrasive blast environment to improve durability and/or longevity).

Figure 13:
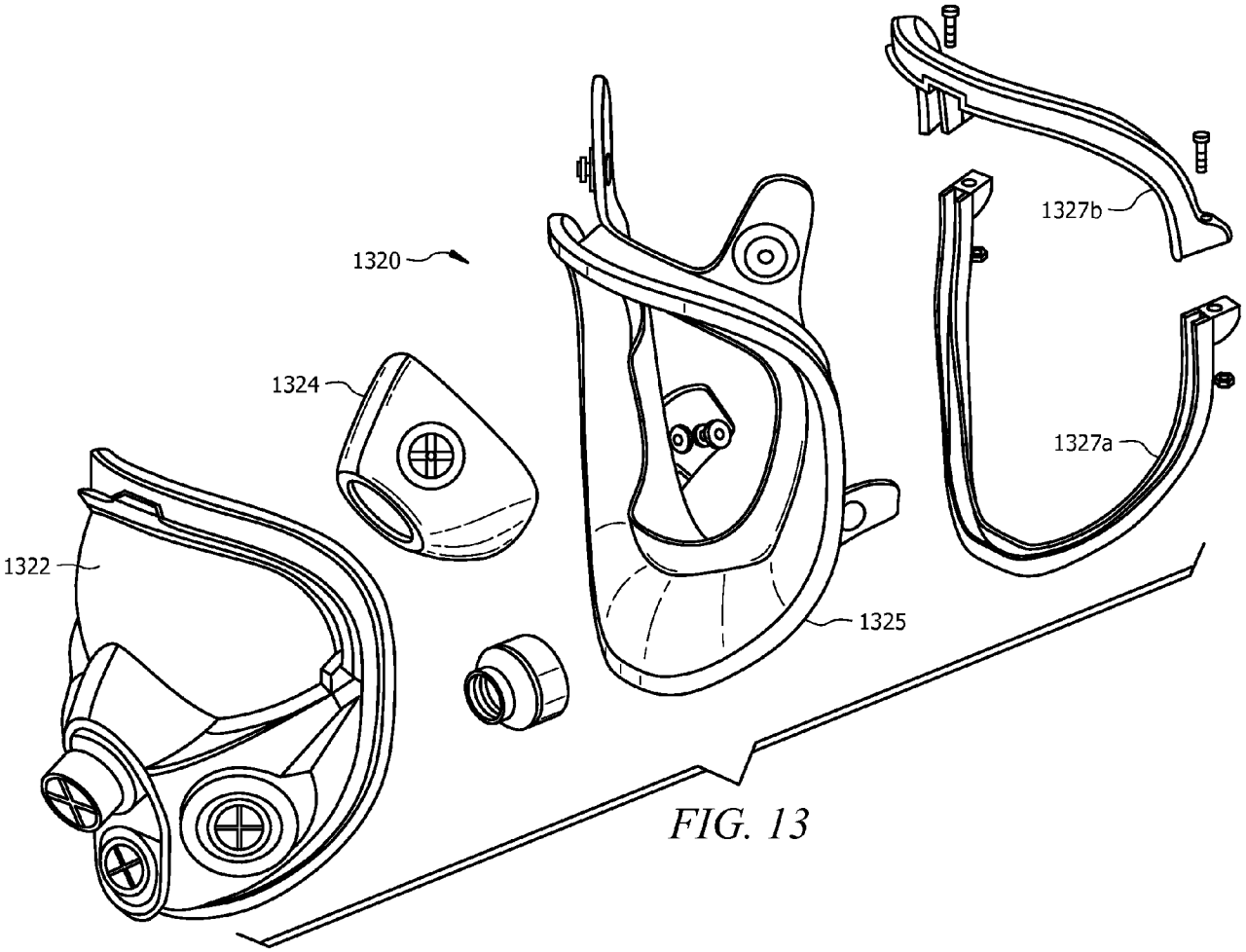
FIG. 13 illustrates an exploded view of an exemplary embodiment of a facepiece assembly.
Figure 14:
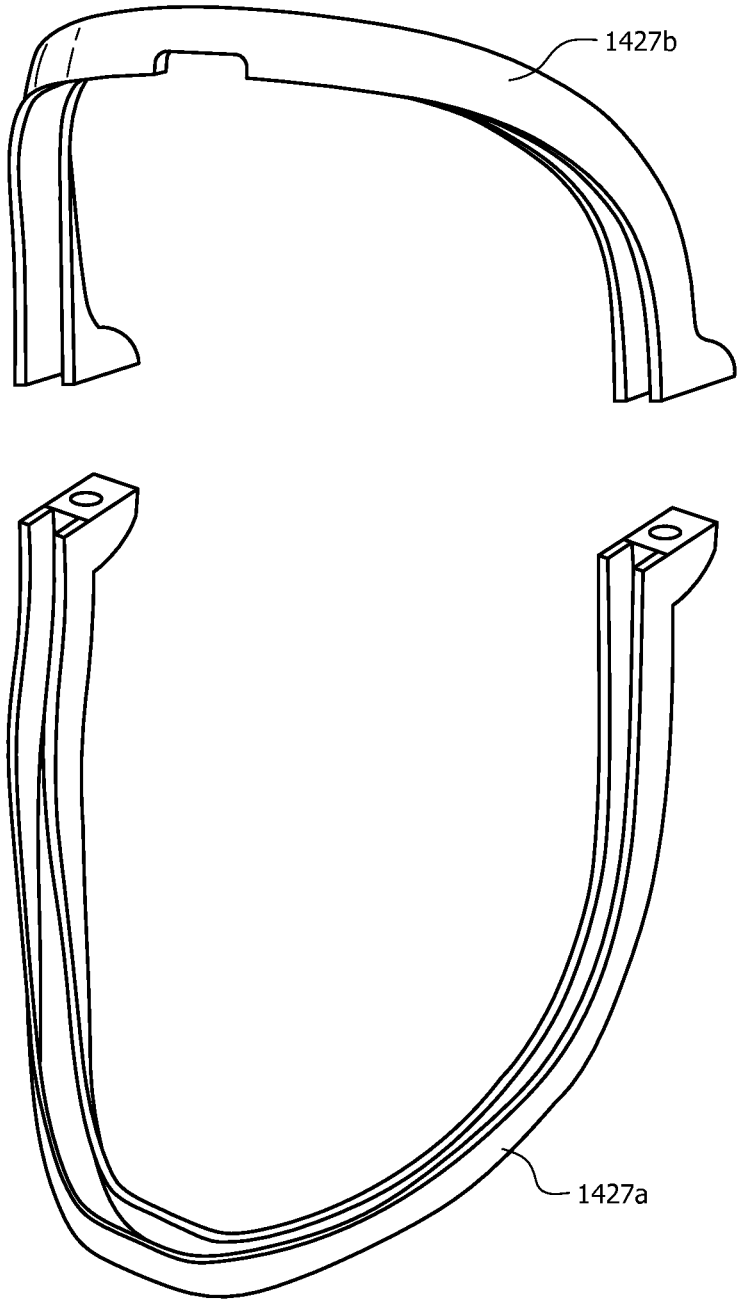
FIG. 14 illustrates an exemplary embodiment of a lens clamp.

FIG. 13 illustrates an embodiment of the facepiece assembly 1320 in more detail. In addition to the facepiece base lens element 1322, this figure illustrates a nose cup 1324, a face seal 1325, and clamp elements 1327*a, b*. The nose cup 1324 may be an optional element that may provide comfort and/or ergonomic benefit to the facepiece. It is typically shaped and located within the facepiece to direct the user's exhalation of air (exhaust air) to the exhalation valve (to improve its functionality) and/or away from the lens viewport of the base lens of the facepiece (to prevent fogging, for example), and/or to direct inhalation air from the breathing hose away from the exhalation valve (so that, for example, the exhalation valve may be primarily controlled and/or influenced by user exhalation, minimizing the impact of the pressurized air from the breathing hose).

The face seal is designed to securely form a seal on the user's face, so that the facepiece may form an enclosed breathing atmosphere isolated and sealed from the external environment. The face seal is shaped and formed of material operable to form a tight seal to the user's face (and to accommodate many different user face shapes). Typically, the face seal has one or more straps (only partially shown in FIG. 13) attached to its rear, for securement of the facepiece onto the user's head. The straps typically may be tightened to form a secure and tight seal fit with the user's face, or loosened to aid in removal of the facepiece or respirator. The facepiece base lens 1322 and face seal 1325 are securely attached, and in FIG. 13 they are attached by means of a pair of clamps 1327*a,b*. FIG. 1.4 illustrates exemplary clamp elements 1427*a,b*, which are typically removably but securely joined, via screw attachment for example. The clamps may be typically tightened into secure joinder, with the face seal located between the clamps and the facepiece base lens element (typically with the shape of the clamps interacting with the shape of the perimeter of the facepiece to form a secure attachment affixing the face seal to the facepiece). Typically, when the straps are tightened while the facepiece is in place on the user's face, the face seal seals sufficiently tightly to the user's face so that there may be no leakage at one inch of water column vacuum.

Many of the elements of the respirator embodiments shown herein may be securely but removably joined or attached, since this may allow for easy disassembly for cleaning and or replacement of worn elements or parts. And many of the elements or parts or features described herein may be optional in one or more embodiments. Typically, the respirator embodiments (for example as shown in FIGS. 1 and 2) provide workers in abrasive blasting environments with respiratory, eye, and face protection. The respirator could be employed with an optional cape or coat or coveralls (or other protective clothing) as well, if additional protection is needed (for other parts of the user's body, for example). Often, users may be wearing gloves as well, such that the design of the respirator may need to be able to accommodate the lessened manual dexterity associated with protective gloves. And often a belt may be worn to support the housing block and/or to prevent the airline from weighing or pulling unnecessarily on the respirator. Respirator embodiments may be lightweight (for example to improve ergonomic factors associated with workers wearing the protective equipment over the course of a shift), for example weighing less than 6.75 pounds, or in other embodiments, less than about 5, 4.75, or 4.5 pounds without the Vortex element. And typically, the noise level to which the user might be exposed by using the respirator embodiments might be minimized, for example to under 80 dB or under about 72-73 dB (with or without the Vortex element). One or more noise reduction elements, as discussed above for example, might assist in meeting sound exposure levels, and the capability of wearing hearing protection under the hood may further assist.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present inventions). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A supplied-air respirator comprising:

a hood;

a facepiece having a base lens, an inhalation valve, an exhalation valve, and at least one filter located thereon; and a facemask configured to fit over the facepiece and operable to shield at least portions of the facepiece from an abrasive blast environment;

wherein the inhalation valve, exhalation valve, and at least one filter are located exterior to the hood, and thus not covered by the hood.

2. The respirator of claim 1 wherein the at least one fitter comprises a valve and operates to provide back-up air supply by filtering outside air only in the event that supplied air through the inhalation valve is compromised; and wherein the facemask comprises one or more apertures corresponding to the base lens, the inhalation valve, the exhalation valve, and the at least one filter of the facepiece.

3. The respirator of claim 2 wherein the inhalation valve is an inhalation check valve biased closed but operable to open upon application of supplied air pressure of at least about 1 psi in breathing hose attached to the inhalation valve.

4. The respirator of claim 3 wherein the inhalation check valve comprises a porous airflow element that alters airflow turbulence exiting the inhalation check valve without significantly restricting airflow rate into the facepiece.

5. The respirator of claim 3 further comprising a housing block having a pressure relief valve, wherein the breathing hose does not include a spring therein; and wherein the housing block further comprises a porous plastic muffler element, wherein the respirator further comprises a porous airflow element that alters airflow turbulence entering the breathing hose from the housing block without significantly restricting airflow rate into the breathing hose.

6. The respirator of claim 1 the least one filter comprises a valve and operates to provide back-up air supply by filtering outside air only in the event that supplied air through the inhalation valve is compromised; and wherein the valve of the at least one filer is operable to open based on inhalation by a user breathing in the absence of supplied air though the inhalation check valve.

7. The respirator of claim 6 further comprising a breathing hose and a supplied-air pump located away from the abrasive blast environment and operable to provide pressurized air to the inhalation valve via the breathing hose.

8. The respirator of claim 1 further comprising a single removable protective cover that shields the inhalation valve, exhalation valve, and at least one filter from exposure to the abrasive blast environment.

9. The respirator of claim 8 wherein the cover snaps into place on the facepiece and is operable to removably snap off the facepiece to provide ready access to the at least one filter and the exhalation valve to allow a user to perform positive and negative seal checks; and wherein the facemask and hood are joined into an integral whole.

10. The respirator of claim 1 further comprising a removable lens cartridge that snaps onto the facepiece, the removable lens cartridge having a plurality of removable molded plastic protective lenses stacked in series with gasket seals between adjacent lenses, wherein each gasket seal is securely affixed to the inner surface of an outer adjacent lens and is in sealing contact with the outer surface of an inner adjacent lens.

11. A supplied-air respirator comprising:

a hoot;

a facepiece having a base lens, an exhalation valve and an inhalation valve thereon; and a single removable cover operable to shield the inhalation valve and exhalation valve from an abrasive blast environment;

wherein the exhalation valve and the inhalation valve are not covered by the hood.

12. The respirator of claim 11 further comprising one or more filters located on the facepiece; wherein the inhalation valve is biased closed but operable to open upon application of sufficient pressure in a breathing hose attached to the inhalation valve; and wherein the one or more filters each comprise a valve and operate to provide back-up air supply by filtering outside air only in the event that supplied air through the inhalation valve is compromised as indicated by closing of the inhalation valve.

13. The respirator of claim 12 wherein the one or more filters are not covered by the hood.

14. The respirator of claim 13 wherein the single removable cover is further operable to shield the one or more filters, offering protection from exposure to the abrasive blast environment.

15. The respirator of claim 14 wherein the removable cover comprises a plurality of tabs operable to snap onto the one or more filters, to removably secure the cover in place on the facepiece.

16. The respirator of claim 14 further comprising a breathing hose and a supplied-pump located away from the abrasive blast environment and operable to provide pressurized air to the inhalation valve via the breathing hose;

wherein the breathing hose attaches to the inhalation valve by a swivel assembly which allows the breathing hose to swivel with respect to the inhalation valve on the facepiece; wherein, when the removable cover is in place on the facepiece, the swivel assembly is shielded from the abrasive blast environment by the removable cover; and wherein the removable cover is shaped to allow the breathing hose to extend downward from the swivel assembly out the bottom of the removable cover.

17. The respirator of claim 11 wherein, when in place on the facepiece, the removable cover does not provide airtight fit to the facepiece, but is shaped to protect the inhalation valve and exhalation valve from grit blowback in the abrasive blast environment.

18. A supplied-air respirator comprising:

a breathing hose for providing pressurized air supply from a source located away from an abrasive blast environment in which the respirator is located;

an exhalation valve; and one or more purifying filters operable to prevent grit of the abrasive blast environment from entering the respirator;

wherein the one or more filters we inoperable while the breathing hose provides pressurized air supply but provide beck-up air supply by filtering outside air only in the event that supplied air through the breathing hose is compromised.

19. The respirator of claim 18 further comprising a facepiece and an inhalation check valve;

wherein the one or more filters and the inhalation check valve are located on the facepiece;

wherein the inhalation check valve is biased closed but operable to open upon application of sufficient supplied air pressure;

wherein the breathing hose attaches to the inhalation check valve to provide pressurized supplied air to the respirator; and wherein the one or more filters each comprise a valve operable to open based on closure of the inhalation valve.

20. The respirator of claim 19 further comprising a hood, a facemask configured to fit over the facepiece and operable to shield at least portions of the facepiece from the abrasive blast environment, and a removable protective cover, wherein the hood does not cover the inhalation check valve, the exhalation valve, or the one or more filters; and wherein the protective cover shields the inhalation check valve, exhalation valve, and one or more filters from the abrasive blast environment when in place on the facepiece.

* * * * *